US006297776B1

(12) United States Patent
Pankinaho

(10) Patent No.: US 6,297,776 B1
(45) Date of Patent: Oct. 2, 2001

(54) ANTENNA CONSTRUCTION INCLUDING A GROUND PLANE AND RADIATOR

(75) Inventor: Ilkka Pankinaho, Paimio (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/567,828

(22) Filed: May 9, 2000

(30) Foreign Application Priority Data

May 10, 1999 (FI) ..... 991068

(51) Int. Cl.[7] ..... H01Q 1/38
(52) U.S. Cl. ..... 343/700 MS; 343/846
(58) Field of Search ..... 343/700 MS, 846, 343/848, 860, 861, 862

(56) References Cited

U.S. PATENT DOCUMENTS 5,124,733 6/1992 Haneishi ..... 343/700
5,585,807 * 12/1996 Takei ..... 343/702
6,008,762 * 12/1999 Nghiem ..... 343/700 MS
6,133,881 * 10/2000 Kushihi et al. ..... 343/700 MS

FOREIGN PATENT DOCUMENTS 99219 7/1997 (FI) .

OTHER PUBLICATIONS

"Handbook Of Microstrip Antennas", Clarricoats et al., IEE Electromagnetic Waves Series 28, vol. 1, 1989.
"Analysis, Design, And Measurement Of Small And Low–Profile Antennas", Hirasawa et al., Artech House, 1992.

* cited by examiner

*Primary Examiner*—Tan Ho
(74) *Attorney, Agent, or Firm*—Perman & Grren, LLP

(57) ABSTRACT

An antenna construction according to the invention has a radiator, ground plane and at least one matching element. The matching element is capacitively coupled to a ground potential. By varying the number, location and strength of the capacitive coupling of the matching elements the characteristics of the antenna construction, such as the number of resonance frequencies, resonance frequencies and radiator impedance at the feed point can be controlled in a versatile manner.

12 Claims, 5 Drawing Sheets

ANTENNA CONSTRUCTION INCLUDING A GROUND PLANE AND RADIATOR

FIELD OF THE INVENTION

The invention relates to compact antenna systems, in particular to antenna constructions operating on a plurality of frequency bands.

BACKGROUND OF THE INVENTION

A conventional microstrip antenna comprises a ground plane and a radiator isolated therefrom by a dielectric layer. The resonance frequency of the microstrip antenna depends on the dimensions of the radiator and on the distances between the radiator and ground plane. Microstrip antenna constructions are described in general e.g. in the "Handbook of Microstrip Antennas" by J. R. James and P. S. Hall (Eds.), Vol 1, Peter Peregrinus Ltd, London 1989 and in "Analysis, Design, and Measurement of Small and Low-Profile Antennas" by K. Hirasawa and M. Haneishi, Artech House, Boston 1992. From the prior art it is known microstrip antenna constructions in which one edge of the radiator is short-circuited to the ground plane. Using such an arrangement a given resonance frequency can be achieved with considerably smaller physical dimensions than the simplest microstrip antenna described above. FIG. 1 illustrates such a microstrip antenna in cross section. FIG. 1 shows a ground plane 20, radiator 10 and a feed line 30. The radiator 10 is short-circuited at its first end to the ground plane 20 through a short-circuiting part 11. The second end of the radiator is open. FIG. 1 does not specifically show the dielectric medium which may be air, for example. Microstrip antennas are often implemented on printed circuit boards, in which case there is the usual dielectric pcb material between the radiator 10 and ground plane 20.

A typical problem with planar antenna constructions according to the prior art is their thickness and narrow band. Antennas used in personal mobile communications devices must be small in size. However, making the microstrip antenna thinner makes the usable frequency band of the antenna narrower. Many mobile communications systems require a relatively wide frequency band, e.g. the DCS-1800 system requires a 10% frequency band, approximately, relative to the center frequency.

In the GSM system, for example, the transmit and receive bands are spaced at 45 MHz from each other, the transmit band being 890–915 MHz and the receive band 935–960 MHz. With an antenna of a single resonance the frequency band should be considerably wide, at least 890–960 MHz in the case of GSM. Because of manufacturing tolerances and objects near the antenna, such as e.g. the hand of the user, which affect the resonance frequency, the bandwidth must be even wider than in the ideal case.

A second approach is to realize an antenna with two frequency bands such that the first frequency band corresponds to the transmit band and the second frequency band corresponds to the receive band. In that case the frequency bands of the antenna need not be as wide as those of a single-band antenna. Such dual-band antennas may comprise e.g. two helix antennas tuned to different frequencies or a combination of a rod antenna and a helix, where the rod and helix are tuned to different frequency ranges. Such constructions are described e.g. in Finnish patent application no. 952780. However, such helix antenna constructions are difficult to realize inside the housing of a mobile communications device. Furthermore, these arrangements only operate on two frequency bands. However, future multi-mode mobile communications devices operating in more than one mobile communications system require antenna constructions operating in more than two separate frequency bands.

Microstrip constructions can be used to realize many different antenna solutions, say, constructions with more than one operating band. FIG. 2 shows an example of such a construction. FIG. 2 shows a ground plane 20, radiator 10 and a feed line 30. A gap 15 divides the radiator 10 in two parts having different resonance frequencies. The radiator may also have more gaps and more parts in which case there are several resonance frequencies as well.

Planar dual-band antenna constructions are disclosed e.g. in US Pat. No. 5,124,733. Said patent publication discloses a microstrip antenna construction which has in addition to a ground plane one active radiating element and a second passive element. The elements are quarter-wave elements short-circuited to the ground plane through one edge. The elements have differing resonance frequencies so that the antenna construction has two separate operating frequency bands. A disadvantage of such a solution is the thickness of the two stacked antenna elements. Furthermore, this solution, too, allows for operation on two frequency bands only.

FIG. 2 shows only one feed line 30. It is also known to use more than one feed point and feed line so that the properties of the antenna, such as the resonance frequency, directivity and diversity characteristics, for instance, can be influenced by choosing the feed point used. The characteristics of the antenna construction can also be influenced by the shape and size of the radiator in the antenna construction and by the size difference and distance between the radiator and ground plane, for example.

SUMMARY OF THE INVENTION

An object of the invention is to provide an antenna construction which is adaptable and modifiable in many ways. Another object of the invention is provide said antenna construction which is also simple to manufacture. A further object of the invention is to provide an antenna construction the characteristics of which can be electronically controlled during operation.

The objects of the invention are achieved by realizing a microstrip antenna construction having a matching element capacitively coupled to the ground plane. The characteristics of the antenna construction can be controlled in a very versatile manner by controlling the strength of the capacitive coupling of the matching element and the location of the matching element.

The antenna construction according to the invention is characterized by what is expressed in the characterizing part of the independent claim directed to the antenna construction. The mobile communications device according to the invention is characterized by what is expressed in the characterizing part of the independent claim directed to the mobile communications device. Other preferred embodiments of the invention are disclosed in the dependent claims.

The antenna construction according to the invention has a radiator, ground plane and at least one matching element. The matching element is capacitively coupled to a ground potential. The characteristics of the antenna construction, such as the number of resonance frequencies, resonance frequencies and the radiator impedance at the feed point, can be controlled in a very versatile manner by controlling the number and location and the strength of the capacitive coupling of the matching elements.

BRIEF DESCRIPTION OF THE DRAWINGS

The invention is below described in more detail with reference to the preferred embodiments presented by way of example and to the accompanying drawings in which

Like elements in the drawings are denoted by like reference designators. FIGS. 1 and 2 were already discussed in connection with the description of the prior art.

DETAILED DESCRIPTION OF THE PREFERRED EMBODIMENTS OF THE INVENTION

Figure 1:
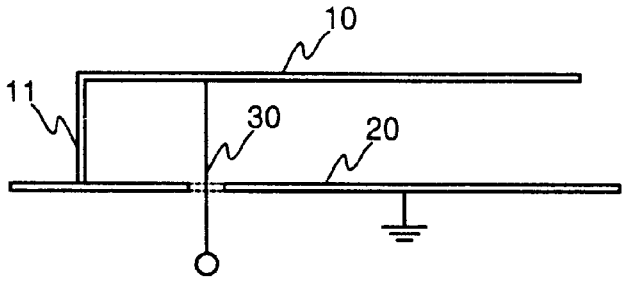
Fig. 1 PRIOR ART
FIG. 1 shows a microstrip antenna according to the prior art.
Figure 2:
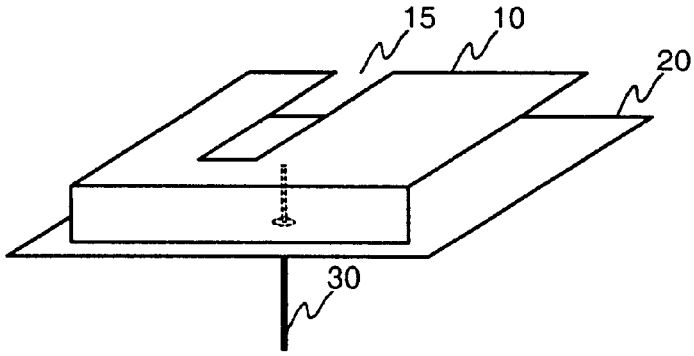
Fig. 2 PRIOR ART
FIG. 2 shows a second microstrip antenna according to the prior art.
Figure 3:
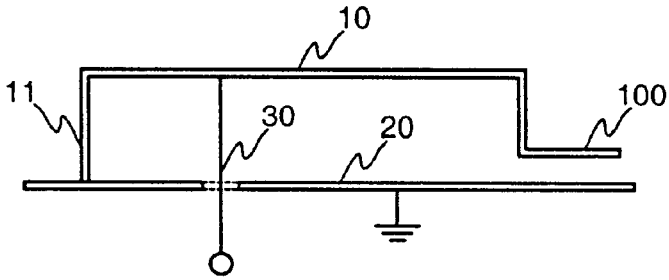
FIG. 3 shows an antenna construction according to a preferred embodiment of the invention.

FIG. 3 illustrates the antenna construction according to a preferred embodiment of the invention. FIG. 3 shows a ground plane 20, radiator 10, short-circuiting part 11 that short-circuits the radiator to the ground plane, and a feed line 30. In the embodiment according to FIG. 3 there is a matching element 100 at the free end of the radiator. The matching element may be produced e.g. by bending a portion of the radiator 10, in this case the open end, towards the ground plane, whereby the capacitive coupling between the matching element and ground plane is stronger than in other parts of the radiator. In this kind of an embodiment the capacitive coupling between the matching element and ground plane can be adjusted e.g. by varying the distance between the matching element and ground plane and by varying the matching element area. Using this kind of a matching element the characteristics of the radiator and thus the whole antenna construction can be varied in many different ways. The capacitance of the matching element can be chosen e.g. through experimentation such that the resonance frequency or bandwidth or some other property of the antenna construction, such as the radiator impedance at the feed point, for example, are as desired.

The matching element can be dimensioned such that the radiator will have a voltage maximum at the matching element whereby the matching element corresponds to an open end or edge of the radiator. Such an embodiment is illustrated by FIG. 3. A matching element 100 at the open end of the radiator increases the capacitance at the open end of the antenna, thus decreasing the resonance frequency of the antenna. The capacitance of the matching element 100 placed at the open end of the radiator strongly influences the resonance frequency of the antenna so that the resonance frequency of the antenna may be advantageously controlled using, in addition to the matching element, a capacitive element, such as e.g. a capacitance diode, coupled to the matching element, which capacitive element has a narrow capacitance adjustment range, yet achieves a considerable resonance frequency adjustment range.

Figure 4:
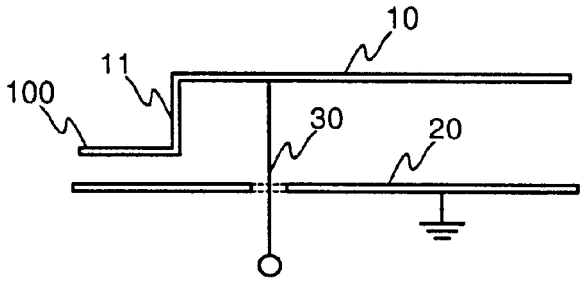
FIG. 4 shows an antenna construction according to a second preferred embodiment of the invention.

FIG. 4 illustrates a second preferred embodiment of the invention. FIG. 4 shows a ground plane 20, radiator 10 and a feed line 30. In the embodiment according to FIG. 4 a matching element 100 is placed at the closed end of the radiator. In this embodiment the part 11 that connects the closed end of the radiator to the ground plane is connected to the ground plane through the matching element 100. As illustrated by FIG. 4, the matching element 100 facilitates a tapping-like coupling to the ground plane, i.e. a current maximum can be created at the matching element. A matching element 100 placed at the closed end of the radiator increases the inductiveness of the radiator so that the radiator will resonate at ¼ wavelength instead of ½ wavelength.

The antenna construction may have more than one matching element 100. Matching elements may be located at all sides of the radiator. A given side may also have more than one matching element.

Figure 5A:
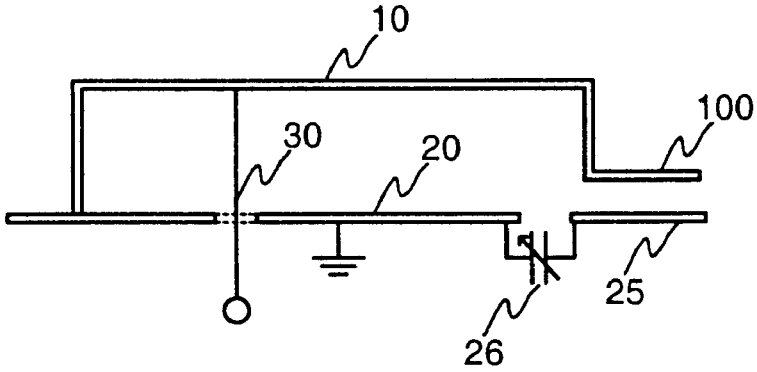
FIGS. 5*a* and 5*b* illustrate preferred embodiments of the invention where a matching element is capacitively coupled to the ground plane through a separate conductive patch.

FIG. 5*a* illustrates a preferred embodiment of the invention in which a radiator 10 is coupled through a matching element to a separate conductive patch 25 which is capacitively coupled to the ground plane 20 proper. The coupling of the separate conductive patch to the ground plane can be realized using a fixed capacitance element or variable capacitance element 26 such as a varactor. The capacitance element 26 may also be realized by means of a combination of one or more fixed and one or more variable capacitive elements, such as e.g. a fixed capacitor and a varactor. The separate conductive patch may be realized e.g. as an electrically conductive pattern on a printed circuit board. Such a separate conductive patch makes it possible to control the coupling of the matching element to the ground plane in a versatile manner. In this kind of an embodiment the strength of the coupling between the matching element and ground plane is affected by both the capacitive coupling between the matching element 100 and the separate conductive patch 25 and the capacitance of the capacitance element 26. FIG. 5*a* also shows a feed line 30.

In a second preferred embodiment of the invention the ground plane 20 and the separate conductive patch 25 may be coupled to each other by means of a switching element, such as e.g. a PIN diode or FET transistor, in addition to or instead of capacitance elements. This way it is possible to relatively strongly affect the coupling between the matching element 100 and ground plane 20 by means of the switch.

Figure 5B:
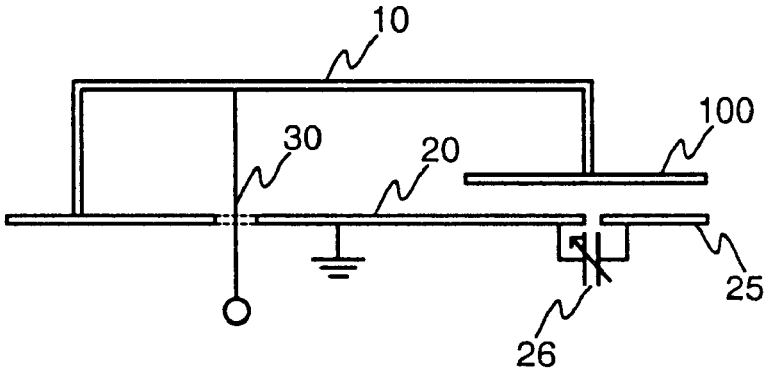

FIG. 5*b* illustrates a preferred embodiment of the invention in which a radiator 10 is coupled through a matching element 100 to both the ground plane 20 and separate conductive patch 25, which in turn is capacitively coupled to the ground plane 20 through a capacitance element 26. One and the same matching element may thus be coupled to both the ground plane and the separate conductive patch. In different embodiments of the invention one and the same matching element may be coupled to more than one separate conductive patch. FIG. 5*b* also shows a feed line 30.

Figure 6:
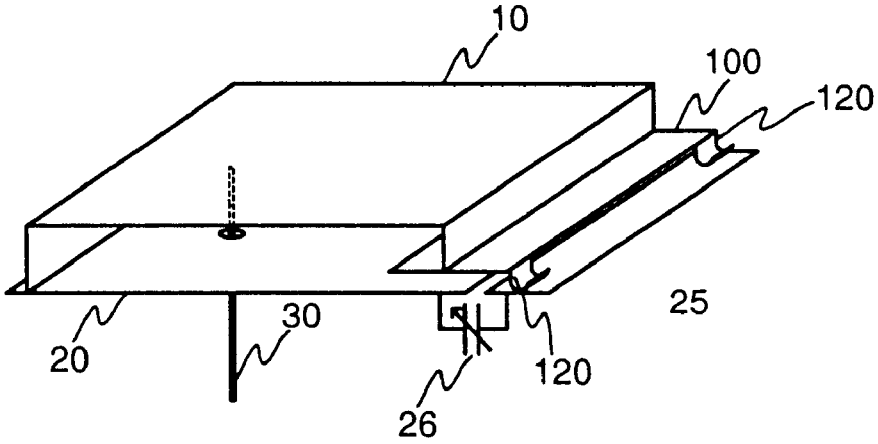
FIG. 6 illustrates a preferred embodiment of the invention that employs matching lines.

FIG. 6 shows a preferred embodiment of the invention that utilizes matching lines 120. In this embodiment, matching lines 120 are used to galvanically connect a matching element 100 to a separate conductive patch 25 which in turn is connected through a capacitive element 26 to the ground plane. In this example the matching element 100 also extends in between the radiator 10 and ground plane 20 whereby the matching element 100 is coupled to the ground plane 20 twice: capacitively directly from the matching element to the ground plane and via the matching lines 120, separate conductive patch 25 and capacitive element 26. In such a construction the characteristics of the antenna construction are influenced e.g. by the dimensions of the matching lines 120 and capacitive element 26 as well as by the distance between the matching element 100 and ground plane. FIG. 6 also shows a feed line 30.

Figure 7:
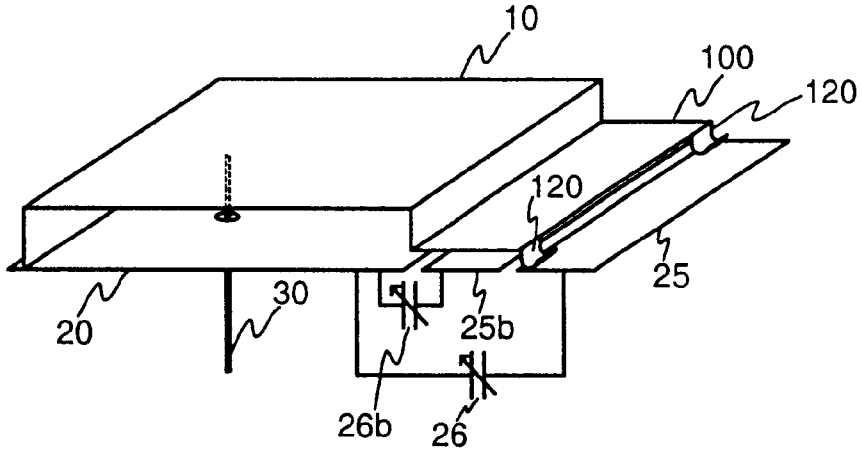
FIG. 7 illustrates a second preferred embodiment of the invention that employs matching lines.

FIG. 7 shows a second example of a preferred embodiment of the invention that utilizes matching lines 120. In this embodiment the matching lines 120 galvanically connect a matching element 100 to a separate conductive patch 25 which in turn is connected through a capacitive element 26 to the ground plane. In this example the matching element 100 is coupled to the ground plane 20 twice: via the matching lines 120, separate conductive patch 25 and capacitive element 26 as well as via a second separate conductive patch 25*b* and capacitive element 26*b*. In this kind of an embodiment the characteristics of the antenna construction are influenced e.g. by the dimensions of the matching lines 120 and capacitive elements 26, 26*b* as well as by the distance between the matching element 100 and the second separate conductive patch 25*b*. FIG. 7 also shows a feed line 30 and radiator 10. As illustrated by the example of FIG. 7, different embodiments of the invention may use more than one separate conductive patch 25, 25*b*, say, two or more separate conductive patches.

Figure 8:
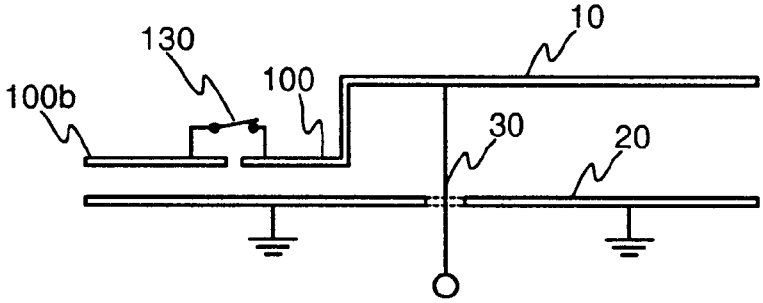
FIG. 8 illustrates a preferred embodiment of the invention in which the matching element comprises multiple parts.

In some preferred embodiments of the invention the matching element 100 may also comprise a plurality of parts. FIG. 8 illustrates such an embodiment. In the embodiment of FIG. 8 the matching element 100, 100*b* is comprised of two parts connected by a switching element 130. The coupling between the matching element parts 100, 100*b* may also be realized e.g. by means of a spring, friction or crimp coupling instead of a separate switching element 130. Matching element part 100*b*, which is separate from the antenna 100, 10 proper, may be placed in various locations at the mobile communications device, say, on the body, printed circuit board or battery module of the mobile communications device. Such an embodiment allows for various structural solutions as the different parts of the antenna construction may be attached to different structural entities.

A matching element may also comprise more than two parts connected to each other through a switching element. In such an embodiment the strength of the capacitive coupling between the matching element and ground plane is also influenced by the quantity of matching element parts connected together at any one time. Such an embodiment advantageously uses an electronic switching element, such as a FET transistor, for example, as the switching element 130, whereby the characteristics of the antenna construction can be controlled by software, say, by the control unit of the mobile communications device.

Figure 9:
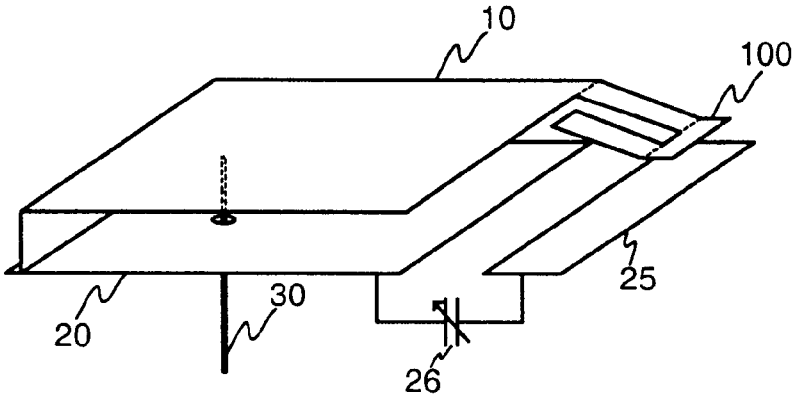
FIG. 9 illustrates the structure of a matching element according to a preferred embodiment of the invention.

FIG. 9 illustrates the structure of a matching element 100 according to a preferred embodiment of the invention. In this embodiment the matching element 100 faces the separate conductive patch 25 only at a certain point so that the capacitive coupling between the matching element and conductive patch 25 is realized only at that point. In a different embodiment of the invention the matching element may also be above the ground plane 20 at a certain point. FIG. 9 also illustrates a design of the matching element 100 parallel to the ground plane and a design perpendicular to the ground plane. FIG. 9 also shows a radiator 10, ground plane 20, feed line 30 and a capacitive element 26 that couples the separate conductive patch to the ground plane.

Figure 10:
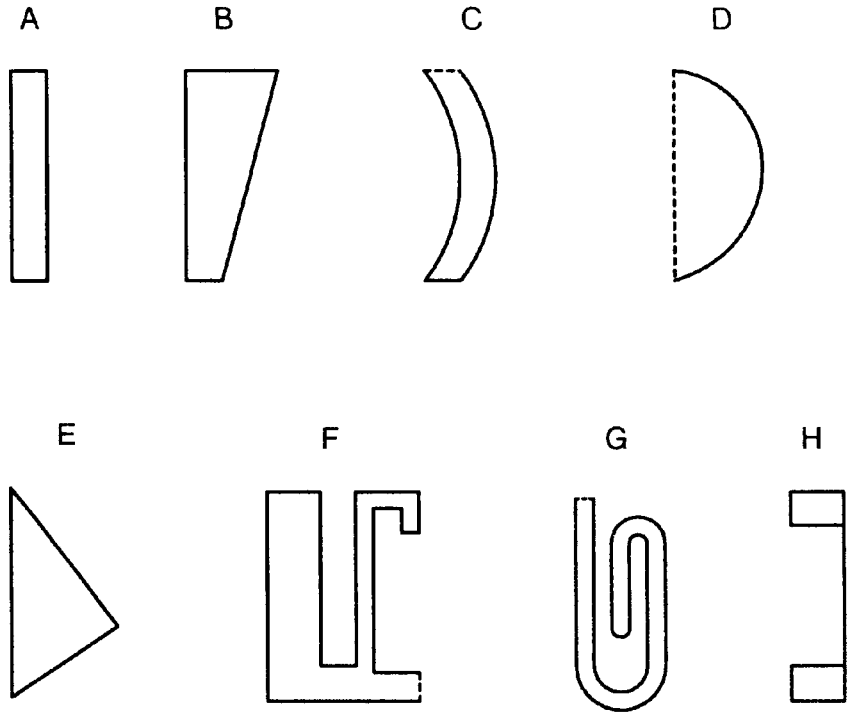
FIGS. 10A–10H illustrate other matching element structures according to different embodiments of the invention.

The matching element 100 may also be designed in many other ways than those described in the examples above. FIG. 10 illustrates examples of matching element shapes according to various embodiments of the invention. The matching element may be e.g. rectangular or square, as in examples A and B in FIG. 10, or curved or semicircular as in examples C and D. The matching element may also be triangular as in example E. Also more complex combinations of differently shaped strips, rectangles and curves are advantageous, as shown in examples F, G and H in FIG. 10. Example F in FIG. 10 is well suited e.g. to an embodiment in which one and the same matching element is used for coupling to two different targets such as e.g. two separate conductive patches or ground plane and a separate conductive patch. Some examples of FIG. 10 show in broken lines sides of the matching element that are particularly suitable for attaching the matching element to the radiator.

Figure 11:
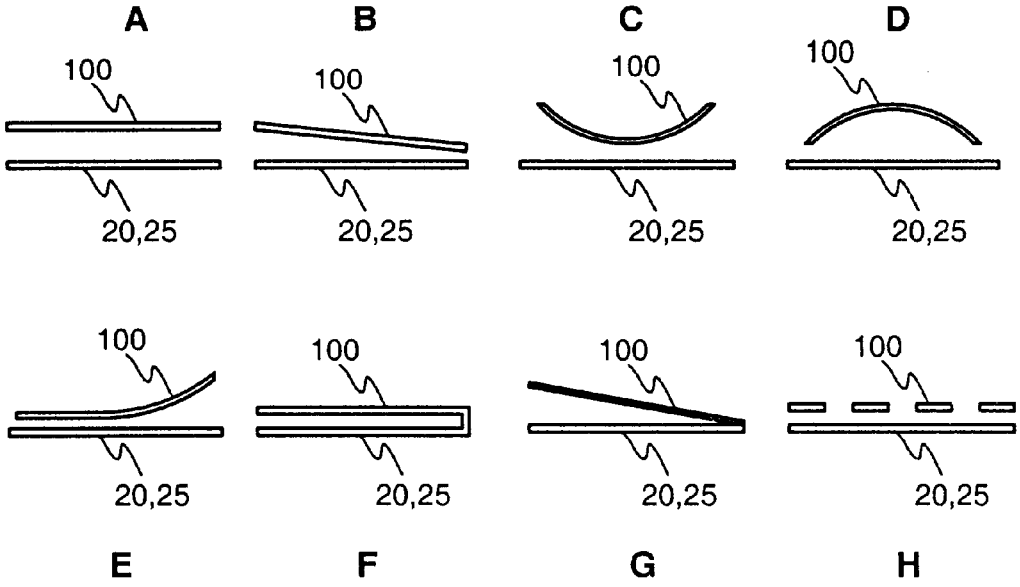
FIGS. 11A–11H illustrate other matching element structures according to different embodiments of the invention, and FIGS. 12*a,* 12*b* and 12*c* illustrate different embodiments of the invention in which at least part of the antenna construction according to the invention is fitted in the battery module of the mobile communications device.

FIG. 11 illustrates, perpendicular to the ground plane, cross sections of matching elements according to preferred embodiments of the invention. The matching element 100 may be parallel to the ground plane 20 or separate conductive patch 25 according to example A in FIG. 11, or divergent, as in example B. The matching element 100 may also be designed curved, the convex side facing the ground plane 20 or separate conductive patch 25 as in example C, or the concave side facing the ground plane 20 or separate conductive patch 25 as in example D. Combinations of the basic shapes are also possible, as illustrated by example E. Examples F and G in FIG. 11 illustrate a situation where the matching element is galvanically connected to the ground plane 20 or separate conductive patch 25. The connection may be realized using a matching line, as depicted by example F, or the matching element 100 may extend without a separate matching line to the ground plane 20 or separate conductive patch 25, as illustrated by example G. The matching element 100 may also be comprised of several parts in accordance with example H. By means of the exemplary alternatives shown in FIG. 11 it is possible to control the characteristics of the matching element and hence the whole antenna construction in many different ways.

The antenna construction according to the invention finds particular utility in mobile communications devices. The antenna construction can be placed in a mobile communications device in many different ways. Below are described some examples of the placement of the antenna construction according to the invention in a mobile communications device. It should be noted that these embodiments are just illustrative examples and do not in any way limit the different implementations of the antenna construction according to the invention.

A problem with mobile communications devices is the lack of space available. This affects particularly the design of antenna constructions in mobile communications devices. The antenna of a mobile communications device is typically placed at the rear of the device, away from the user. Typically, the battery of the mobile communications device is also placed at the rear side of the device because the front side is needed to realize a user interface, i.e. a keypad and a display. The battery is typically realized as a removable battery module so that the user can easily replace the battery. The battery module limits the rear area available to the antenna of the mobile communications device. In some preferred embodiments of the invention at least part of the antenna construction of the mobile communications device is placed in the battery module of the mobile communications device. Such an embodiment makes possible better optimization of the space usage. The embodiment is particularly advantageous in connection with antenna constructions according to the invention for in many different embodiments of the invention the matching elements add to the area required by the antenna construction.

Figure 12A:
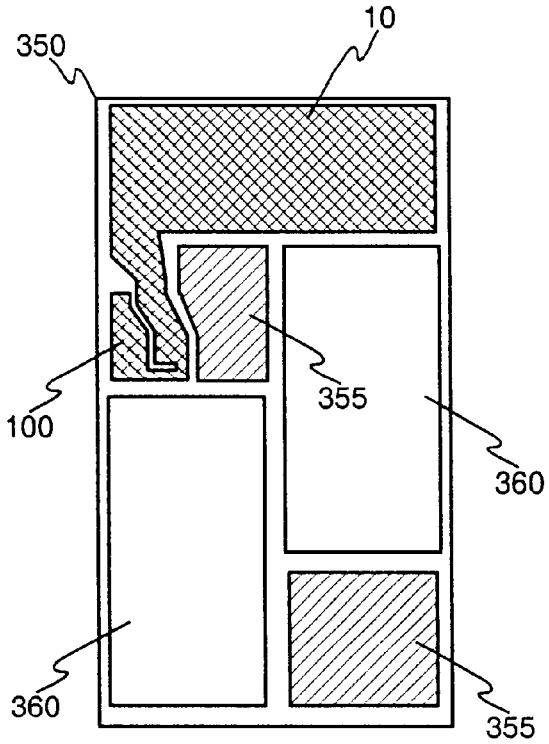

FIG. 12*a* illustrates the structure of a battery module 350 according to a preferred embodiment of the invention. The battery module comprises battery cells 360 and components, such as electronic control elements and connectors 355, related to the battery module functions. In this embodiment the battery module also comprises a radiator 10 and matching element 100. The placement of the parts of the antenna construction in the battery module makes it possible to utilize the optimization possibilities achieved by means of changes in the internal structure of the battery module. The battery cells are relatively large components so that space is easily left between the antenna construction and a battery cell, which space can be utilized for the placement of other components 355 in the battery module. The internal structure of the battery module thus facilitates many different modifications. The structure of FIG. 12*a* is just one example of a possible structure and does not limit the different implementations of the invention in any way.

Figure 12B:
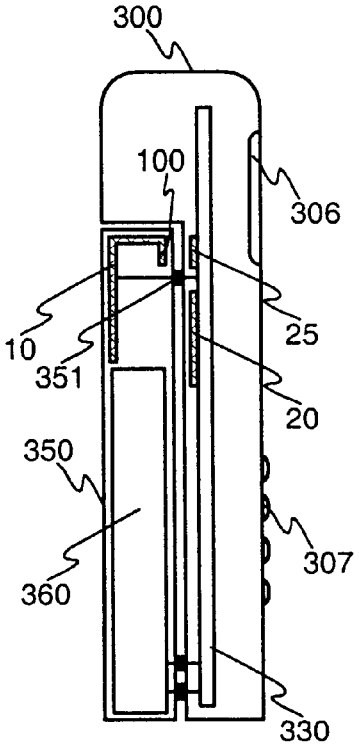

FIG. 12*b* illustrates a second preferred embodiment of the invention where part of the antenna construction is in the battery module. FIG. 12*b* shows a mobile communications device 300 comprising a user interface, in this example a display 306 and keypad 307, on the front side of the mobile communications device. The mobile communications device also comprises a printed circuit board 330 which has a ground plane 20 and a separate conductive patch 25 realized by means of electrically conductive patterns. Typically the mobile communications device comprises other components as well, but for simplicity these are not shown in FIG. 12*b*. In FIG. 12*b* the mobile communications device includes a battery module 350 which in this example comprises a battery cell 360, radiator 10 and a matching element 100 attached to the radiator. Antenna feed is realized through a connector 351 from the mobile communications device to the battery module and further to the radiator. In this embodiment the ground plane 20 of the antenna construction is located at the mobile communications device side, on its printed circuit board 330. The matching element 100 is realized in such a manner that its distance from the separate conductive patch 25 is smaller than the distance between the radiator 10 and ground plane 20, whereby the capacitive coupling between the matching element and separate conductive patch is weaker than that between the radiator and ground plane.

Figure 12C:
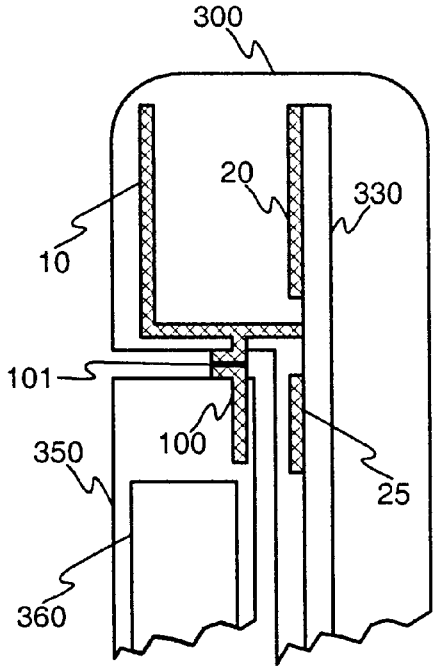

FIG. 12*c* illustrates a third preferred embodiment of the invention where part of the antenna construction is located in the battery module 350. In the example of FIG. 12*c* the ground plane 20, radiator 10 and separate conductive patch 25 of the antenna construction are located on the side of the mobile communications device and the matching element 100 on the side of the battery module 350. In the embodiment of FIG. 12*c* the radiator 10 and matching element are galvanically connected to each other through contact 101. FIG. 12*c* also shows a printed circuit board 330 and battery cell 360 in the mobile communications device.

The antenna construction according to the invention finds utility in mobile stations of many different cellular systems and in small base stations. In particular the antenna construction according to the invention is applicable in mobile communications devices of the GSM and UMTS systems. The antenna construction according to the invention finds particular utility in applications where the mobile communications device must be able to monitor more than one frequency range, such as e.g. mobile communications devices operating in both the GSM 900 and GSM 1800 systems. The antenna construction according to the invention is also applicable to other compact radio apparatus, such as base stations of wireless intercom systems and mobile communication systems based on micro- and picocell networks. The controllability of the antenna construction according to the invention as well as the great number of frequency range options provided by the antenna construction makes the use of the antenna construction according to the invention particularly advantageous also in forthcoming software radio systems, where the frequency ranges and radio interface functions such as modulations used, are selected by software so that the mobile station can be adapted to another mobile communication system just by changing the software at the mobile station.

A matching element according to the invention can be used for controlling many different properties of an antenna construction. The matching element can be used e.g. to influence the directivity of the antenna construction or its diversity characteristics as well as its resonance frequency or frequencies and the quantity of the resonance frequencies, the bandwidth of each resonance band or e.g. the largest continuous bandwidth of the antenna construction. In addition, the matching element can be used to influence the impedance of the feed point.

The matching element according to the invention can be realized in many different ways according to the application in question. For example, if the radiator is made from a thin metal plate, the matching element can be implemented by having a projection of a desired shape in the radiator and bending said projection in the vicinity of the ground plane or separate conductive patch. The matching element may also be realized in many other ways, say, by soldering, crimping or otherwise attaching the matching element to the radiator. If the radiator is implemented using a conductive pattern on a printed circuit board, the matching element can be realized on the other side of the printed circuit board or by means of a conductive pattern formed on an intermediate layer of a multilayer board. In such an embodiment the matching element may be connected to the radiator using conventional pcb manufacturing techniques, e.g. by means of one or more metal-plated through holes.

The antenna construction according to the invention has many advantages. The antenna construction according to the invention is simple to manufacture, yet provides a wide range of control for the characteristics of the antenna construction. Matching elements placed in different locations of the radiator can be used to control a great number of properties of the antenna construction. The antenna construction according to the invention thus facilitates versatile control options during the manufacture of the antenna construction. Moreover, the antenna construction according to the invention makes it possible to control the characteristics of the antenna construction also during the use of the antenna construction, e.g. by using a varactor to vary the strength of the capacitive coupling between the matching element and ground plane. This way, a mobile communications device can control e.g. the resonance frequency of the antenna in accordance with the communications frequency used.

Furthermore, the antenna construction according to the invention has the advantage of being applicable to reduce the effect of external lossy materials, such as other parts of the mobile communications device or materials outside the mobile communications device such as the hand of the user, on the resonance frequency of the antenna construction. In general it can be said that the resonance frequency of the antenna decreases as a lossy material affects the radiator and antenna ground plane at the same time. This applies to nearly all antenna constructions of mobile communications devices in which the electrical area of the mobile communications device body is greater than the area of the antenna construction. The matching element 100 or matching elements 100 of the antenna construction according to the invention strengthen the coupling between the radiator and ground plane, whereby the coupling between the mobile communications device body or materials outside the body and the antenna construction becomes relatively weaker. Thus the effect of the mobile communications device body or materials outside the body on the resonance frequency of the antenna construction is smaller than in antenna constructions according to the prior art.

It is obvious to a person skilled in the art that the different embodiments of the invention are not limited to the examples described above but they can vary in accordance with the claims appended hereto.

What is claimed is:

1. An antenna construction having a ground plane and a radiator, and having at least one resonance frequency comprising:

at least one matching element at the open end of the antenna construction, said matching element being in a galvanic connection with the radiator such that the capacitive coupling between the matching element and ground plane at the at least one resonance frequency is stronger than the capacitive coupling between the radiator and ground plane.

2. An antenna construction according to claim 1 further comprising a separate conductive patch wherein at least one matching element comprises a matching element that is capacitively coupled to said separate conductive patch.

3. An antenna construction according to claim 2, wherein said conductive patch is coupled to the ground plane through a capacitive element.

4. An antenna construction according to claim 2, further comprising a switching element for selectively coupling said conductive patch to the ground plane.

5. An antenna construction according to claim 1, further comprising more than one part in said matching element, and a switching element for selectively coupling said more than one parts to each other.

6. A mobile communications device which has an antenna construction comprising at least a ground plane and radiator comprising in the antenna construction of the mobile communications device at least one matching element at the open end of the antenna construction, the matching element being in a galvanic connection with the radiator such that the capacitive coupling between the matching element and ground plane at said at least one resonance frequency is stronger than the capacitive coupling between the radiator and ground plane.

7. A mobile communications device according to claim 6 further comprising in the antenna construction of the mobile communications device, a conductive patch;

a capacitive element for connecting said conductive path to the ground plane, wherein at least one matching element comprises a matching element that is capacitively coupled to said conductive patch.

8. An antenna construction having a ground plane and a radiator, and having at least one resonance frequency comprising:

at least one matching element in galvanic connection with the radiator such that the capacitive coupling between the matching element and ground plane at the at least one resonance frequency is stronger than the capacitive coupling between the radiator and ground plane, further comprising a separate conductive patch wherein at least one matching element includes a matching element that is capacitively coupled to said separate conductive patch.

9. An antenna construction according to claim 8, wherein said conductive patch is coupled to said ground plane through a capacitive element.

10. An antenna construction according to claim 8, further comprising a switching element for selectively coupling said conductive patch to said ground plane.

11. An antenna construction according to claim 8, further comprising more than one part in said matching element, and a switching element for selectively coupling said more than one part to each other.

12. A mobile communications device which has an antenna construction including at least a ground plane and radiator comprising in the antenna construction of the mobile communications device at least one matching element in galvanic connection with the radiator such that the capacitive coupling between the matching element and ground plane at the at least one resonance frequency is stronger than the capacitive coupling between the radiator and ground plane further comprising in the antenna construction of the mobile communications device, a conductive patch, and a capacitive element for connecting the conductive path to the ground plane, wherein at least one matching element includes matching elements that are capacitively coupled to the conductive patch.

* * * * *